US005367998A

United States Patent [19]

Shiohara et al.

[11] Patent Number: 5,367,998

[45] Date of Patent: Nov. 29, 1994

[54] FUEL INJECTION SYSTEM FOR AN ENGINE

[75] Inventors: Masakazu Shiohara; Tsugunori Konakawa, both of Iwata, Japan

[73] Assignee: Yamaha Hatsudoki Kabushiki Kaisha, Iwata, Japan

[21] Appl. No.: 27,682

[22] Filed: Mar. 8, 1993

[30] Foreign Application Priority Data

Mar. 6, 1992 [JP] Japan ..... 4-084941

[51] Int. Cl.[5] ..... F02M 41/00

[52] U.S. Cl. ..... 123/457; 123/65 PE; 123/73 C; 123/459; 123/580; 123/583; 123/54.4; 73/707

[58] Field of Search ..... 123/73 C, 73 CC, 73 CB, 123/73 B, 65 PE, 400, 514, 73 A, 73 AC, 303, 579, 580, 583, DIG. 2, 55 VS, 55 VF, 457, 459; 73/706, 707, 756

[56] References Cited

U.S. PATENT DOCUMENTS

| | | | |
|---|---|---|---|
| 4,446,833 | 5/1984 | Matsushita et al. | 123/73 C |
| 4,625,701 | 12/1986 | Bartlett et al. | 123/514 |
| 4,989,568 | 2/1991 | Sougawa | 123/456 |
| 5,190,006 | 3/1993 | Motoyama et al. | 123/65 PE |

FOREIGN PATENT DOCUMENTS

| | | | |
|---|---|---|---|
| 63-186914 | 8/1988 | Japan | 123/65 PE |
| 2-45624 | 2/1990 | Japan . | |
| 2-45647 | 2/1990 | Japan . | |
| 2-45649 | 2/1990 | Japan . | |

*Primary Examiner*—Noah P. Kamen

*Attorney, Agent, or Firm*—Knobbe, Martens, Olson & Bear

[57] ABSTRACT

A fuel injection and control system for a V-type, two cycle, crankcase compression, internal combustion engine. The fuel injection system includes fuel injectors positioned in the valley of the engine and which are supplied with fuel under pressure from a fuel tank through a line in which a fuel filter and fuel pump are positioned. The fuel pump and fuel filter are disposed at one end of the engine and the amount of pressure supplied to the fuel injectors is controlled by a pressure regulator that regulates pressure by bypassing excess fuel back to the fuel filter upstream of the filter element. A throttle control and throttle position sensor are disposed at the opposite end of the engine and exhaust control valves are provided outside of the valley of the "V" of the engine. The amount of air flow to the engine is sensed by a crankcase pressure sensor and an arrangement is incorporated for preventing damage to the crankcase pressure sensor by isolating it from negative pressure conditions which exist at times in the crankcase chamber.

23 Claims, 6 Drawing Sheets

FUEL INJECTION SYSTEM FOR AN ENGINE

BACKGROUND OF THE INVENTION

This invention relates to a fuel injection system for an engine and more particularly to an improved fuel injection system embodying pressure regulation and the layout of the components relative to the engines that facilitate servicing and an improved way of sensing air flow to the engine for controlling the amount of fuel injected.

The use of fuel injection in order to improve engine performance both in the terms of fuel economy and exhaust emission control is gaining wide acceptance. With fuel injection systems, there is provided a high pressure fuel injection which injects fuel into the engine for its combustion. The fuel may be injected either into the induction system or directly into the cylinder. In order to insure adequate and accurate fuel control, it is necessary to insure that the pressure of the fuel supplied to the fuel injectors is maintained at the desired value. In order to accomplish this, it is the normal practice to employ a pressure regulator that regulates the pressure of the fuel supplied to the injector. These pressure regulators normally regulate pressure by dumping excess fuel back to the fuel system so as to maintain the desired pressure at the regulator.

Although this type of regulation obviously is advantageous, there are certain problems in connection with the design of the system. For example, if the regulator regulates by dumping the excess fuel back to the fuel tank, then extremely long conduitries are required. On the other hand, if the regulator dumps the fuel back into the inlet to the fuel pump, then it may be necessary to provide plural fuel filters and complicated piping.

It is, therefore, a principal object to this invention to provide an improved fuel pressure regulating system for the fuel injection system of an internal combustion engine.

It is a further object to this invention to provide a regulating system for a fuel injected engine wherein pressure is regulated by dumping the excess fuel directly back to the fuel filter of the engine, thus eliminating the necessity of multiple filters.

Although fuel injection systems have obvious advantages in more accurate fuel control for the engines, they also require a number of components over and above those of conventional carbureted engines. The layout of these components can provide problems, particularly with many types of applications. For example, in a motorcycle the vehicle is very compact and there is very little space for the positioning of the various components of the fuel injection and engine control systems. In addition to the positioning of the components, it is also desirable to position the components so that individual components requiring servicing can be easily accessed.

It is, therefore, a still further object to this invention to provide an improved arrangement for positioning the various components of a fuel injection and control system that offer ease of access.

It is a specific object to this invention to provide a layout for a fuel injected internal combustion engine wherein the fuel pump and fuel filter may be positioned at one end of the engine and the throttle control and throttle position sensor can be positioned at the other end of the engine.

Two cycle engines offer another application where fuel injection may have particular utility. Because of the porting overlap common with two cycle engines, fuel injection control may be desirable to improve such engine's performance. However, the layout of components for two cycle engines also provides particular challenges.

Frequently, in order to improve the performance of a two cycle engine there is provided one or more valves that control the flow through the exhaust ports so as to control the exhaust port timing. Such exhaust control valves can significantly improve the performance of two cycle engines and accommodate various running conditions. However, the actuating mechanism for such exhaust control valves obviously provides a still further complexity to the engine construction.

It is, therefore, a still further object to this invention to provide an improved layout for a fuel injected, two cycle internal combustion engine and for positioning of the fuel injectors and exhaust control valves so that they can be easily operated and will not interfere with each other.

With two cycle engines, it has been determined that the amount of air flowing to the engine can be accurately and easily measured by measuring the pressure in the crankcase chambers. Such crankcase pressure measurement has a number of advantages in that it avoids the necessity of positioning flow sensors in the induction system which could be damaged or which could interfere with the air flow to the engine.

Crankcase pressure sensors as a means for measuring air flow normally measure the crankcase pressure at a time when the charge is being compressed so as to provide pressure signals that will be indicative of the air inducted into the crankcase chamber. However, there are times when the crankcase chamber is also at a sub-atmospheric pressure and if the pressure sensor is subjected to these sub-atmospheric pressures as well as to high pressures, problems can result.

It is, therefore, a still further object to this invention to provide an improved crankcase pressure sensor control for an injection system for a two cycle engine wherein the pressure sensor is protected from undesirable pressure signals.

SUMMARY OF THE INVENTION

A first feature of this invention is adapted to be embodied in a fuel injection system for an internal combustion engine that comprises a fuel tank, a fuel filter remote from the fuel tank and supply conduit means for connecting the fuel tank to the fuel filter. A fuel pump is provided for pumping fuel from the fuel tank to the fuel filter. A fuel injector receives fuel from the fuel pump and supplies fuel to the internal combustion engine for its operation. A pressure regulator is incorporated for regulating the pressure of the fuel supplied by the fuel pump to the fuel injector. The pressure regulator regulates pressure by by-passing fuel from the fuel pump away from the fuel injector. In accordance with this feature of the invention, bypass conduit means return the fuel bypassed by the fuel pressure regulator directly to the fuel filter.

Another feature of the invention is adapted to be embodied in a fuel injection system for an internal combustion engine having a main body rotatably journalling an output shaft that is rotatable about an axis. The axis extends between opposite ends of the engine and a fuel pump and fuel filter are provided at one end of the engine. Throttle means are provided for controlling the speed of the engine and throttle actuating means and throttle position sensing means are disposed at the other end of the engine for actuating the throttle means and for sensing the position of the throttle means.

Another feature of the invention is adapted to be embodied in a two cycle, crankcase compression, internal combustion engine comprising a pair of cylinder banks disposed at an angle to each other and defining a valley therebetween. Fuel injection means are disposed in the valley for delivering fuel to the engine cylinder banks. Exhaust control valve means for controlling the exhaust port timing of the cylinder banks are disposed on the outside of the valley.

Another feature of the invention is adapted to be embodied in a fuel injection system for a two cycle, crankcase compression engine in which the engine comprises a crankcase chamber into which an atmospheric charge is inducted and compressed for delivery to a combustion chamber. A fuel injector is supplied for delivering fuel to the combustion chamber. Pressure sensing means sense the pressure in the crankcase chamber for providing a control parameter signal for control of the amount of the fuel supplied to the fuel injector. Means are provided for protecting against the transmission of negative pressure signals from the crankcase chamber to the pressure sensing means.

DETAILED DESCRIPTION OF THE PREFERRED EMBODIMENT OF THE INVENTION

Figure 1:
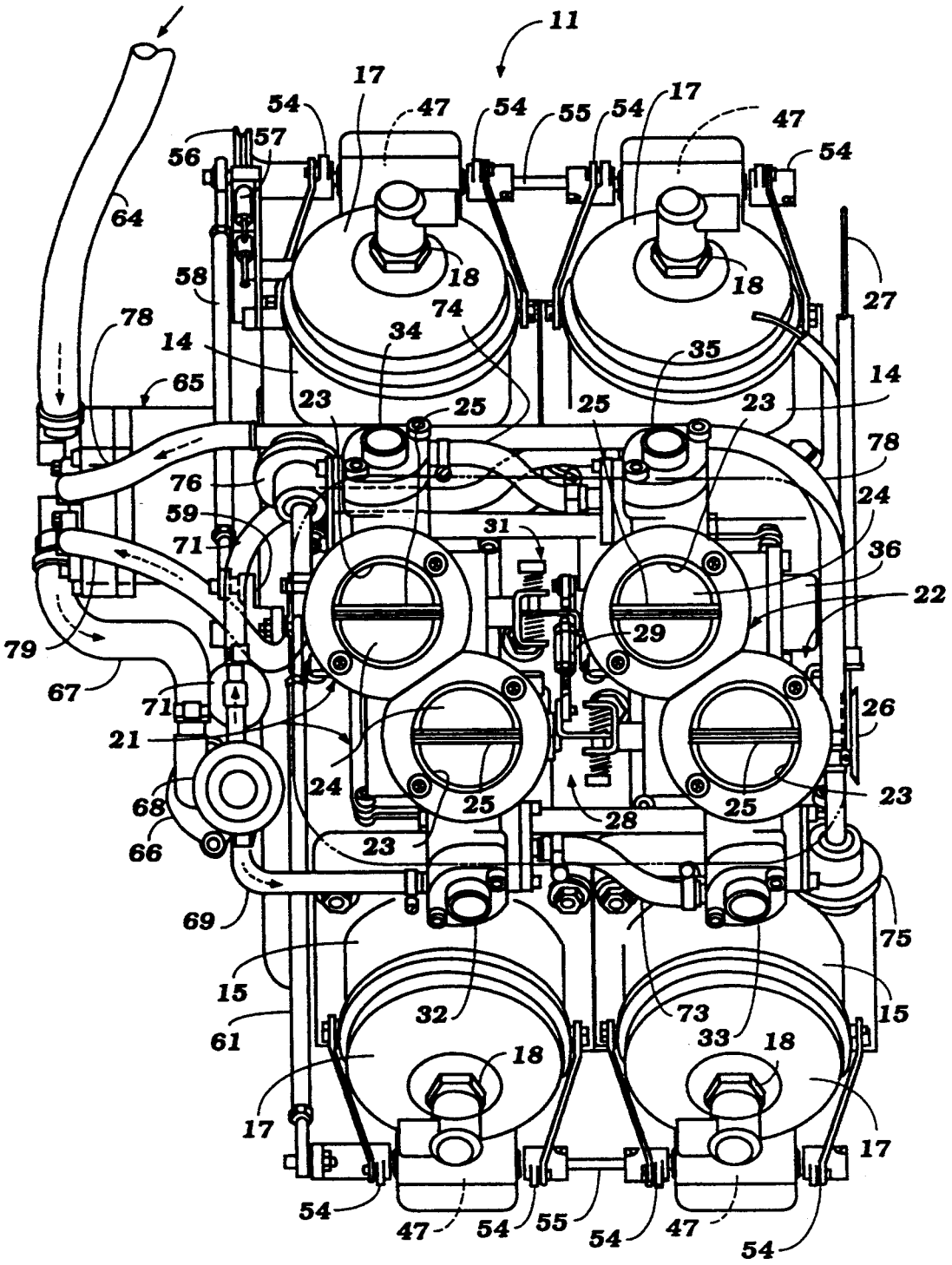
FIG. 1 is a front elevational view of a two cycle internal combustion engine having a fuel injection system constructed in accordance with an embodiment of the invention.
Figure 2:
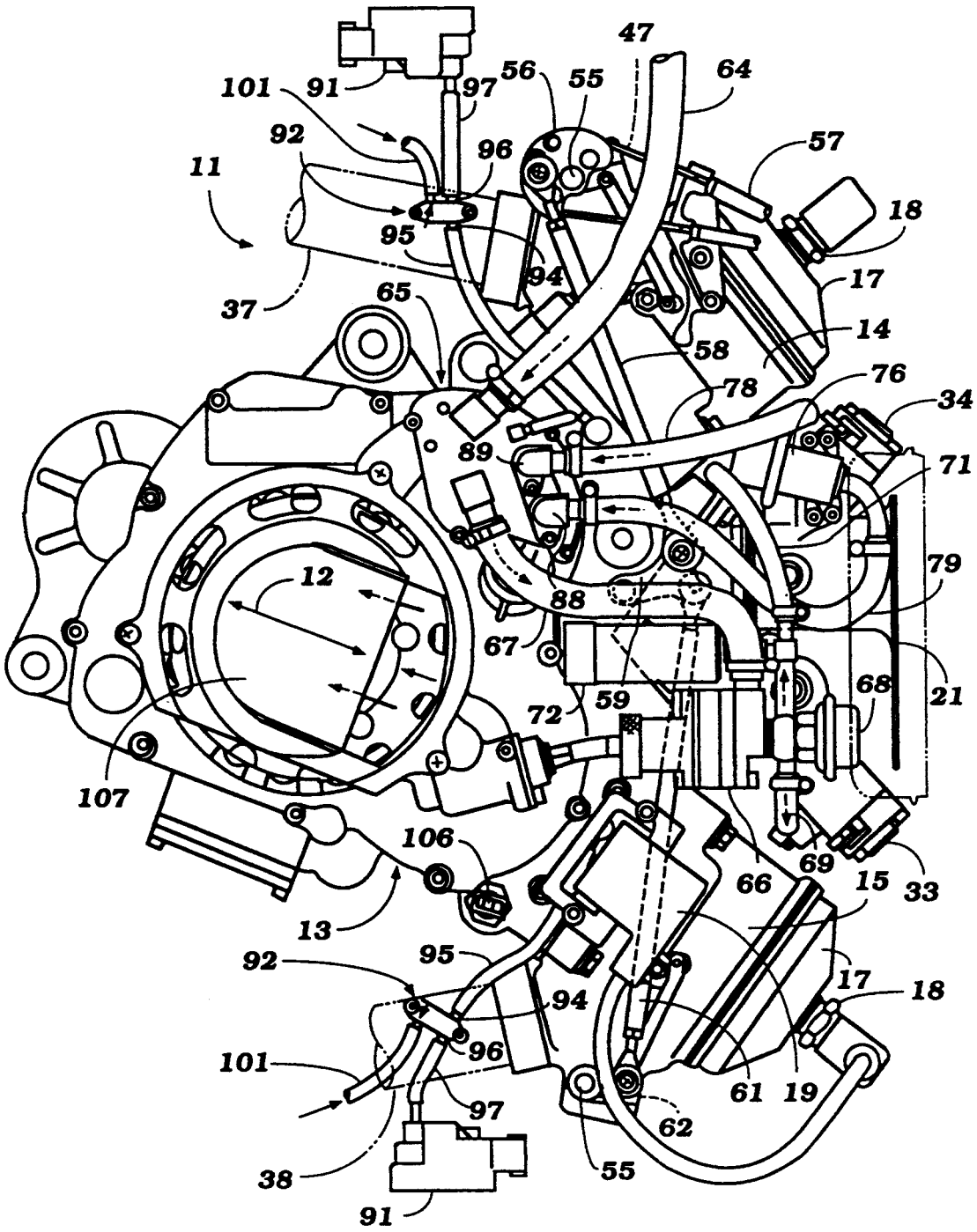
FIG. 2 is a side elevational view of the engine.
Figure 3:
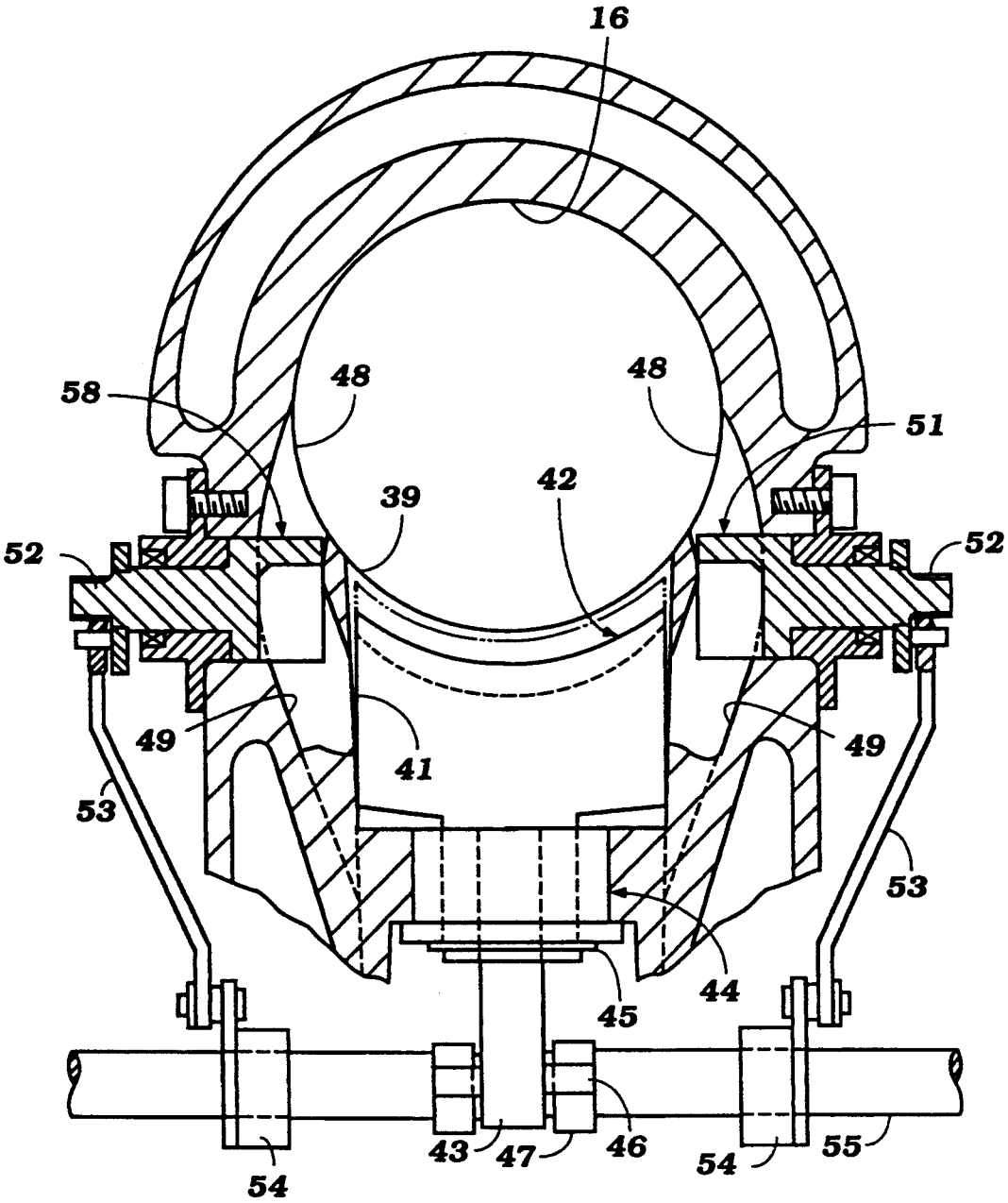
FIG. 3 is a cross sectional view taken through one of the cylinders of one of the cylinder banks and shows the exhaust control valves.

Referring now in detail to the drawings and initially to FIGS. 1 through 3, a two cycle, crankcase compression, fuel injected engine constructed in accordance with an embodiment of the invention is identified generally by the reference numeral 11. In the illustrated embodiment, the engine 11 is depicted as being of the type normally employed for powering a motorcycle. This type of environment is particularly useful for the invention because, as will become apparent, the construction and operation of the invention permits a very compact engine configuration and good injection control while, at the same time, offering maximum accessibility of components requiring servicing. In FIG. 2, the engine 11 is shown rotated slightly in a clockwise direction from the horizontal and the horizontal plane is identified by the line 12 in this figure.

In the illustrated embodiment, the engine 11 is of the crankcase compression, two cycle type and is depicted as being of a V-4 configuration. As should be readily apparent to those skilled in the art, certain features of the invention may be employed with engines other than two cycle, crankcase compression, internal combustion engines and engines having other cylinder configurations. However, the configuration as depicted is exemplary of a configuration in which the invention and various facets of it have particular utility.

The engine 11 include a crankcase 13 in which a crankshaft (not shown) is supported for rotation about an axis that extends generally transversely to a horizontal plane and which defines opposite ends of the engine 11 at the respective ends of the crankshaft and its axis of rotation. As is typical with two cycle engine practice, the chambers of the crankcase 13 in which the crankshaft is rotatably journalled are sealed from each other, for a purpose which is well known in the two cycle practice and which will be described.

A cylinder block assembly is affixed to the crankcase 13 in a known manner and is provided with a pair of angularly disposed cylinder banks 14 and 15. These cylinder banks 14 and 15 are formed with pairs of cylinder bores, one of which appears in FIG. 3 and is identified by the reference numeral 16. As is well known, pistons reciprocate in the cylinder bores 16 and are connected by means of connecting rods to the crankshaft to drive it. Since this portion of the engine may be considered to be conventional, further description of it is not believed to be necessary to understand the invention.

Cylinder heads 17 are affixed to each of the cylinder banks 14 and 15, respectively, and define the combustion chambers along with the cylinder bores 16 and pistons, previously mentioned. Spark plugs 18 are mounted in the cylinder heads 17 and have their gaps extending into the combustion chambers for firing the fuel/air charge therein in a well known manner. The ignition system for firing the spark plugs 18 include individual spark coils 19 mounted on the cylinder banks 14 and 15, respectively.

An intake air charge is supplied to the crankcase chambers formed in the crankcase 13 for the engine 11 by an induction system which includes an air inlet device (not shown) which draws atmospheric air and delivers it to a plurality of pair of throttle bodies 21 and 22 which are positioned in the valley between the cylinder banks 14 and 15. Each throttle body 21 and 22 of the individual pairs includes a respective induction passage 23 in which a flow controlling throttle valve 24 is positioned on a throttle valve shaft 25 that is rotatably journalled in the throttle bodies 21 and 22.

The throttle valves 24 are operated by means of a throttle operating mechanism which includes a throttle pulley 26 that is affixed to one end of one of the throttle bodies of the pair 22 and this is positioned on one end of the engine 11. A wire throttle actuator 27 is connected to the throttle pulley 26 for operating the throttle valve 24 associated with this respective throttle body 22 in a well known manner. The lower throttle body 22 which is directly actuated by the throttle pulley 26 is coupled to the lower throttle valve shaft 25 of the throttle bodies 21 by means of an adjusting and timing mechanism 28 which permits a timing adjustment so as to synchronize the throttle valves 24 of the lower cylinder bank 15 with each other.

A connecting linkage 29 interconnects the throttle valve shaft 25 of the lower throttle body 22 with the upper throttle valve shaft 25 of the upper throttle body 21. A timing mechanism 31 similar to the mechanism 28 connects the throttle valve shaft 25 of the upper throttle body 22 with the corresponding throttle valve shaft 25 of the lower throttle body 21 so that the position of the throttle valves 24 of all of the throttle bodies may be synchronized.

Fuel is supplied to the lower pairs of throttle bodies 21 and 22 by respective pairs of lower fuel injectors 32 and 33 and to the upper throttle bodies 21 and 22 by fuel injectors 34 and 35, respectively. The fuel injectors 32, 33, 34 and 35 are supplied with fuel from a fuel supply system which incorporates features of the invention and which will be described later in more detail. It should be noted, however, that the fuel injectors 32 and 33 are disposed between the lower throttle bodies of the pairs 21 and 22 and the cylinder banks 15 while the fuel injectors 34 and 35 are positioned between the upper of the pairs of the throttle bodies 21 and 22 and the upper cylinder banks 14. This permits a compact assembly.

A throttle valve position sensor 36 is mounted to the upper throttle valve shaft 25 of the one of the throttle body pair 21 and is disposed on the same end of the engine 11 as the throttle actuating pulley 26. This puts the throttle position and controlling mechanism at one end of the engine 11 where they may be easily services and accessed.

The fuel/air charge that passes through the throttle body pairs 21 and 22 flows into the crankcase chambers through an intake manifold (not shown) and which incorporates reed type check valves so as to be drawn into the individual crankcase chambers associated with each of the cylinder bores 16. This charge is drawn in when the respective piston is moving upwardly so as to create a negative pressure in the crankcase chamber. As the pistons move downwardly, this charge will be compressed and transferred to the combustion chambers through suitable scavenge passages (not shown). The charge is then burned by firing of the spark plugs 18 in a well known manner.

As the charge burns and expands to drive the pistons downwardly, it will eventually be discharged through an exhaust system which includes pairs of upper and lower exhaust pipes 37 and 38, respectively (FIG. 2) which extend on the outer sides of the cylinder banks 14 and 15 and away from the valley defined therebetween. This exhaust system includes exhaust control valves, shown in most detail in FIG. 3, so as to control the exhaust port timing and improve the performance of the engine 11.

Referring now specifically to FIG. 3 it should be seen that each cylinder bore 16 is formed with a main exhaust port 39 that communicates with an exhaust passage 41 formed in the respective cylinder banks 14 or 15 and which communicates with the respective exhaust pipes 37 or 38. An exhaust control valve, indicating generally by the reference numeral 42 is slidably supported in this exhaust passage 41 and has an arcuately configured valving surface that is selectively moveable, in a manner to be described, between an inward position in which the timing of the opening of the exhaust port 39 is retarded and the closing of it is advanced so as to provide a higher compression ration, preferably when operating at low and mid range speeds. However, as the engine 11 approaches a high speed, high load condition, the exhaust control valve 42 is moved to a non-flow obstructing position so as to advance the opening of the exhaust port 39 and retard its closing so as to lower the compression ratio. This permits maximum power output at low and mid range speeds without resulting in knocking or high temperatures at high speed, high load conditions.

The exhaust control valve 42 has a stem portion 43 that is slidably supported in a valve support 44 that is fixed to the respective cylinder bank 14 or 15 and which closes the outer end of the exhaust passage 41. A seal 45 sealingly engages the stem 43 and the stem 43 is connected to a pin 46 that operates with a cam mechanism 47 which is controlled by the position of the throttle valves 24 in a manner to be described.

In addition to the main exhaust port 39, there are provided with a pair of auxiliary or sub-exhaust ports 48, each of which is formed on a respective side of the main exhaust port 39 and which communicates with the exhaust passage 41 through a pair of sub-exhaust passages 49. Sub-exhaust control valves 51 control the flow through the sub-exhaust passages 48 in response to engine speed and/or load, as sensed by throttle position. These sub-exhaust control valves 51 have stem portions 52 which are pivotally connected to one end of links 53 that have their opposite ends connected to a further actuator 54 which is also operated in response to throttle position, in a manner to be described.

It should be noted that the exhaust control valves 42 and sub-exhaust control valves 51 are positioned outside of the V formed between the banks of cylinders 14 and 15 and hence this control mechanism can be easily accommodated without interfering with the remainder of the engine accessories and/or components.

The mechanism by which the exhaust control valves 42 and 51 are operated will now be described by additional reference to FIGS. 1 and 2. It should be noted that the valve actuating cam 47 and valve actuators 54 are affixed, at each cylinder bank to a respective exhaust control valve shaft 55. Each of these exhaust control valve shafts 55 are supported for rotation in a suitable manner on the respective cylinder bank and an actuating pulley 56 is affixed to the upper exhaust control valve shaft 55. This exhaust control pulley 56 is connected to a wire actuator 57 which is, in turn, either connected directly to the throttle actuating mechanism or to an ECU which is controlled by the throttle actuating mechanism in an appropriate manner so as to provide the desired sequence of operation of the exhaust control valves 42 and 51 associated with the cylinder banks 14.

To insure simultaneous movement of the exhaust control valves of the lower cylinder banks 15, there is provided a first timing link 58 that has a pivotal connection to the exhaust control valve pulley 56 and is, in turn, pivotally connected to one arm of a bellcrank 59 that is pivotally supported on the cylinder block in a suitable manner. A second exhaust control valve link 61 is pivotally connected at one end to the other arm of the bellcrank 59. The opposite end of the link 61 is pivotally connected to the exhaust control valve shaft 55 of the exhaust control valves associated with the cylinder banks 15 for simultaneous operation, as aforenoted.

It should be noted that the components of the invention as thus far described may be considered to be conventional, except for their specific location on the engine 11. That is, a wide variety of different types of exhaust control valves can be employed. However, it is important that the exhaust control valves are positioned outside of the valley of the V of the engine 11 and that the throttle bodies 21 and 22 are positioned in the V-bank of the engine 11. In addition, the throttle actuating pulley 26 and throttle position sensor 36 are located at one end of the engine 11, in the direction of the axis of rotation of the crankshaft.

The fuel supply system for supplying fuel to the fuel injectors will now be described by primary reference to certain remaining figures, as will be noted. Before referring to the specific details of the components of the fuel supply system for supplying fuel to the fuel injectors 32, 33, 34 and 35, a general layout of the components of the fuel supply system will be described by particular reference to FIG. 5, which is a schematic view of the fuel supply system. The fuel for the engine operation is contained within a fuel tank 63 that is shown schematically and which is mounted appropriately in an area of the motorcycle generally above the engine 11. A fuel supply line 64 connects the fuel tank 63 with a fuel filter assembly 65 having a construction as will be described by reference to FIGS. 4 through 6 and which, in accordance with a feature of the invention, is located at one end of the engine, the end opposite the throttle actuating pulley 26 and the throttle position sensor 37. Fuel is drawn through the filter element of the filter assembly 65 by an engine driven fuel pump 66 which has its inlet port connected to the outlet port of the fuel filter assembly 65 by a conduit 67. The fuel pump 66 is located at the same end of the engine 11 as the fuel filter 65 so as to decrease the length of the supply conduitry and for another reason which will be described.

The fuel pump 66 delivers the fuel under high pressure to a pressure damper 68, which is located at this same end of the engine 11 and which serves a pair of deliver conduits 69 and 71 which extend to the injectors 32, 33, and 34, 35 respectively. A surge tank 72 is positioned in the conduit 69 so as to further provide pressure damping and to minimize variations in fuel pressure in the system. The surge tank 72 is also located at the same end of the engine 11 as the fuel filter 65, fuel pump 66 and pressure damper 68, again limiting the length of the conduits in the system.

Short connecting lines 73 and 74, respectively, connect the fuel injector 33 with the fuel injector 32 and the fuel injector 35 with the fuel injector 34 so that the fuel may flow freely therebetween. Pressure regulators 75 and 76 communicate with the fuel injectors 33 and 34 respectively, with the pressure regulator 75 being located at the opposite end of the engine 11 from the other fuel supply components thus far described and with the fuel pressure regulator 76 being disposed at the same end of the engine 11 as the other components except for the pressure regulator 75. A first, relatively longer return conduit 77 extends from the pressure regulator 75 back to the end of the engine 11 where the other components of the fuel injection system are located and dumps into the fuel filter 65 upstream of its filter element, in a manner to be described. In a similar manner, the pressure regulator 76 dumps excess fuel back into the fuel filter 65 through a return conduit 79.

FIGS. 1 and 2 clearly show the layout of the components wherein the filter 65, fuel pump 66, pressure damper 68, surge tank 72 and pressure regulator 76 are all located at one end of the engine 11, the end opposite that where the throttle actuating pulley 26 and throttle position sensor 36 are positioned. This provides a very compact assembly. Also, since the fuel is returned by the pressure regulators 75 and 76 to the filter element 65 rather than the remotely positioned fuel tank 63, the close proximity of these components permits very short lines to be employed and minimizes the likelihood of leakages and pressure losses.

Figure 4:
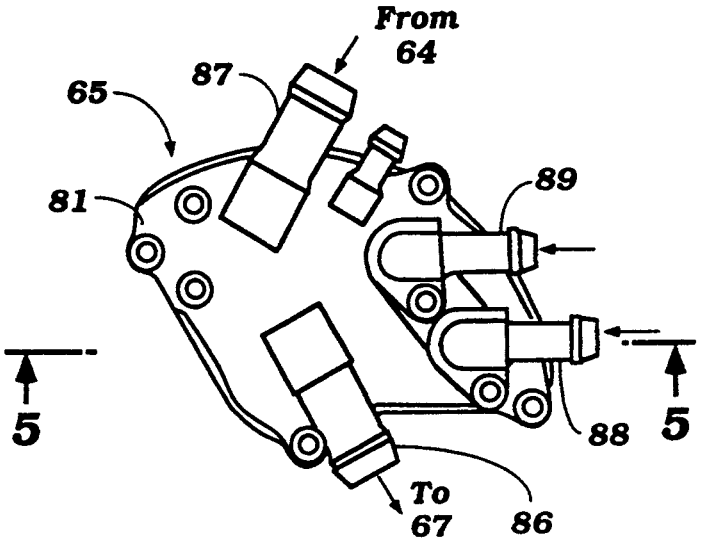
FIG. 4 is a top plan view of the fuel filter.
Figure 5:
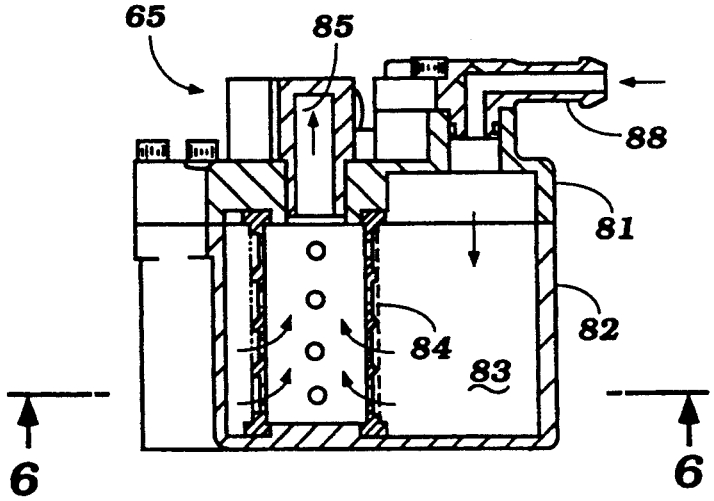
FIG. 5 is a cross sectional view of the fuel filter taken along the line 5—5 of FIG. 4.
Figure 6:
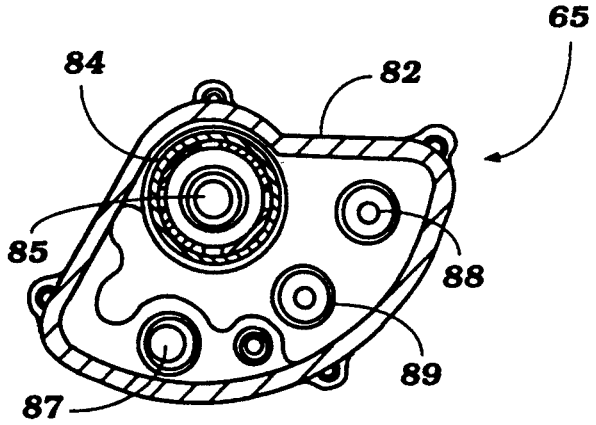
FIG. 6 is a cross sectional view taken along the line 6—6 of FIG. 5.
Figure 7:
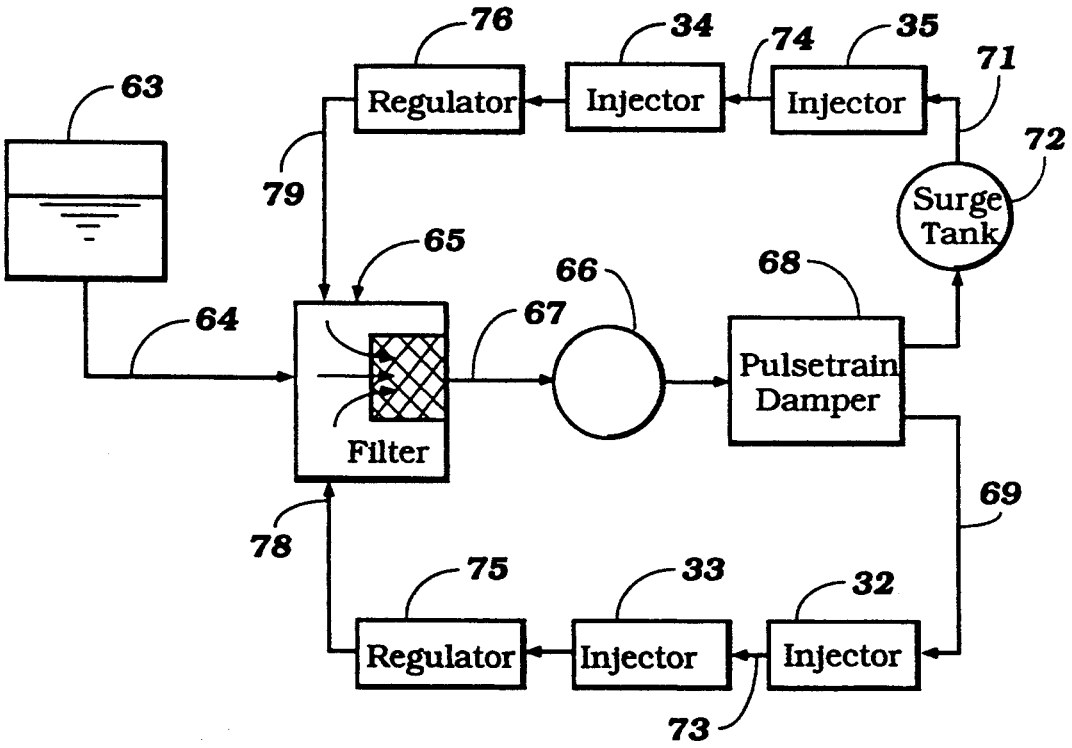
FIG. 7 is a schematic view showing the layout of the fuel supply system for the engine.

The construction of the fuel filter 65 will now be described, by particular reference to FIGS. 4 through 6. The fuel filter 65 includes an outer housing assembly that is comprised of a cover plate 81 and a main housing 82 which are affixed to each other in a suitable manner and which define an internal cavity 83. A generally cylindrical filter element 84 is positioned in this cavity 83 and is designed so as to permit radial fuel flow through the filter element 84 from the cavity 83 to its hollow interior as shown by the arrows in FIG. 5. The hollow interior of the filter element 84 communicates with a discharge cavity 85 formed in the cover plate 81 and from which a supply nipple 86 extends which supply nipple 86 is formed integrally with the cover plate 81. The supply nipple 86 is connected to the supply line 67.

In a similar manner, an inlet nipple 87 is formed integrally with the cover piece 81 and receives the flexible conduit 64 from the fuel tank 63. This inlet nipple 87 communicates with the cavity 83 outwardly of the periphery of the filter element 84 as clearly shown in FIG. 6.

A pair of bypass or return nipples 88 and 89 are also formed integrally with the cover plate 85 and these receive the conduits 79 and 78, respectively, so that the bypassed fuel is returned to the interior of the filter assembly 65 upstream of the filter element 84. In this way, all fuel that is returned will have been passed through the filter element 84 and all fuel that is delivered to the engine 11 will also have been passed through the filter element 84 at least once. Thus, with this layout a single fuel filter assembly 65 supplies the entire requirements for filtering of the engine 11 and multiple components are avoided.

The amount of fuel supplied to the fuel injectors 32, 33, 34, and 35 is governed by a CPU (not shown) that senses a number of both engine operating and ambient conditions so as to provide the requisite amount of fuel supplied. As previously noted, the positions of the throttle valves as sensed by the throttle position sensor 36 is one of the control parameters. It is also desirable to measure air flow to the engine 11 and, as has now been acknowledged, this can be easily and effectively done by providing a sensing of the pressure in the crankcase, particularly at the time immediately before the scavenge passages open.

To this end, there are provided a pair of pressure sensors 91 each of which communicate with respective crankcase chambers associated with cylinders of the banks 14 and 15. However, there are times when the pressure in the crankcase chambers is not positive but rather is below atmospheric pressure, such as when a charge is being inducted into the crankcase. If the pressure sensors 91 are subjected to these negative pressures, then problems can result including possible damage to the pressure sensors 91. In accordance with a feature of the invention, therefore, there is provided an isolating device, indicated generally by the reference numeral 92, which is interposed between the respective crankcase chamber and the pressure sensor 91.

Figure 8:
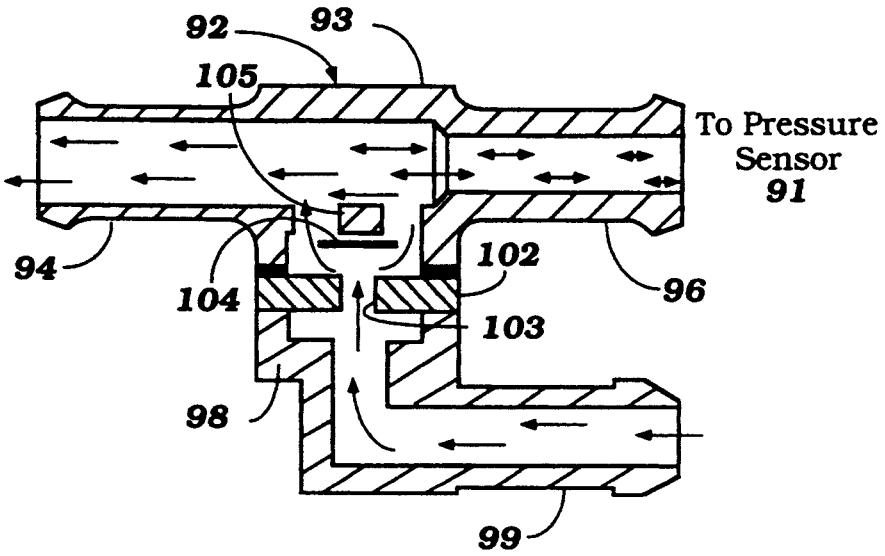
FIG. 8 is an enlarged cross sectional view showing the device for protecting the pressure sensor from negative crankcase pressure conditions at the time when the engine is operating on a suction phase.
Figure 9:
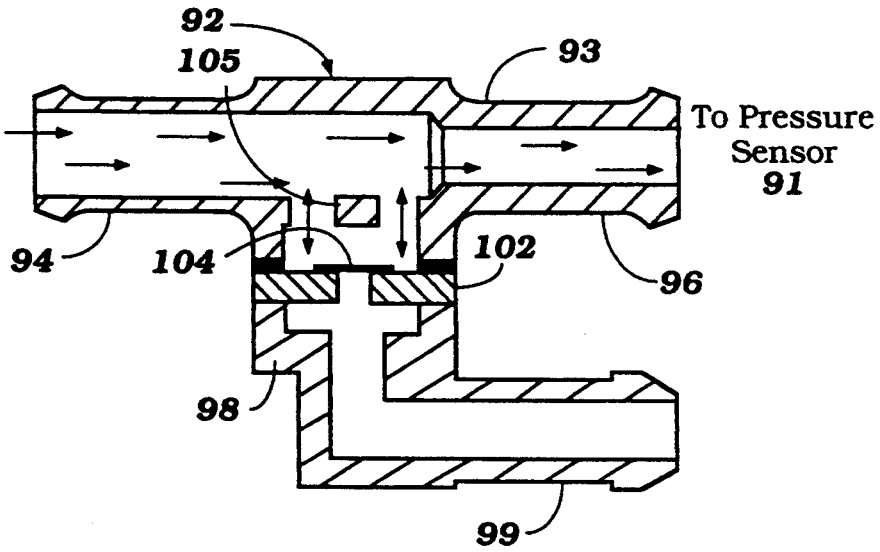
FIG. 9 is a cross sectional view, in part similar to FIG. 8, showing the condition when there is a pressure generated by compression of the intake charge in the crankcase chambers.

The internal construction of these isolating devices 92 is best shown in the cross sectional views of FIGS. 8 and 9 with FIG. 8 showing the condition when a negative pressure is present in the crankcase chamber and FIG. 9 showing the condition when there is a positive pressure and when it is desired to transmit this positive pressure to the pressure sensor 91. The isolating device 92 includes a first portion 93 that has a nipple 94 that receives a flexible conduit 95 which, in turn, goes to the respective crankcase chamber at which the pressure is being sensed. The nipple 94 is generally inline with a further nipple 96 which receives a flexible conduit 97 to provide a connection to the pressure sensor 91.

An atmospheric bleed is provided by a second housing piece 98 which has a nipple 99 that receives a flexible hose 101 which goes to a suitable source of atmospheric air. Preferably, this conduit 101 may extend to the interior of the air cleaner of the engine 11 so that filtered air may pass through the nipple 99. A valve plate 102 is interposed between the housing portions 98 and 93 and has an opening 103 which is adapted to be opened and closed by a floating valve disk 104. The valve disk 104 is held in position by means of a stop 105 which is contained within the housing piece 93. The valve plate 104 in effect operates as a one way check valve so that when there is an induction charge being drawn into the crankcase chambers of the engine 11 due to a reduced position, the valve disk 104 will float to an open position and atmospheric air may enter the isolating device 92 as shown by the arrows in FIG. 8. In this condition, negative pressure will be dampened and not transmitted to the pressure sensor 91.

However, when the crankcase charge is being compressed, the valve disk 104 will be urged to its closed position (FIG. 9) and hence positive crankcase pressures will be transmitted to the pressure sensor 91. In this way, a relative simple but highly effective device is incorporated for protecting the pressure sensors 91 from negative pressure conditions.

In addition to the controls described, various other parameters may be sensed for controlling the amount of fuel supplied to the engine such as the use of a temperature sensor for sensing engine temperature, which temperature sensor is indicated by the reference numeral 106 in FIG. 2 and which communicates with the engine cooling jacket.

As is typical with motorcycle practice, a clutch assembly 107 is provided at one end of the crankcase and this clutch assembly 107 may be cooled by cooling air flow as shown by the arrows in FIG. 2.

It should be readily apparent from the foregoing description that the described fuel injection system provides a very compact assembly and one in which the components may be easily positioned and readily serviced and wherein the fuel pressure can be easily regulated by bypassing fuel directly to a closely positioned fuel filter so that only a single fuel filter need be employed in the system. In addition, the construction is such that the amount of air flowing to the engine can be easily sensed by a crankcase pressure sensor and, at the same time, a very simple arrangement protects this pressure sensor from damage as may be caused by negative readings.

It is to be understood that the foregoing description is that of a preferred embodiment of the invention and that various changes and modifications may be made without departing from the spirit and scope of the invention, as defined by the appended claims.

We claim:

1. A fuel injection system for an internal combustion engine comprising a fuel tank, a fuel filter remote from said fuel tank, supply conduit means for connecting said fuel tank to said fuel filter, a fuel pump for pumping fuel from said fuel tank to said fuel filter, a fuel injector for receiving fuel from said fuel pump and for supplying fuel to said internal combustion engine, a fuel pressure regulator for regulating the pressure of the fuel supplied by said fuel pump to said fuel injector, said fuel pressure regulator regulating pressure by bypassing fuel from said fuel pump from said fuel injector, and bypass conduit means for returning the fuel bypassed by said fuel pressure regulator directly to said fuel filter.

2. A fuel injection system for an internal combustion engine as set forth in claim 1 wherein the fuel filter comprises an outer housing containing a filter element and wherein the bypassed fuel is returned to the filter housing upstream of the filter element.

3. A fuel injection system for an internal combustion engine as set forth in claim 1 wherein there are provided a pair of fuel injectors in series relationship with a single pressure regulator for regulating the pressure supply to each of the fuel injectors.

4. A fuel injection system for an internal combustion engine as set forth in claim 3 wherein the pressure regulator is positioned downstream of the fuel injectors.

5. A fuel injection system for an internal combustion engine as set forth in claim 4 wherein there are two sets of pairs of fuel injectors each receiving fuel from the fuel pump in series fashion and with a pressure regulator downstream of each pair of fuel injectors and each return the fuel to the fuel filter.

6. A fuel injection system for an internal combustion engine as set forth in claim 1 wherein the engine includes an output shaft rotatable about an axis and extending between opposite ends of the engine, the fuel pressure regulator and the fuel pump being disposed at one end of the engine and further including means for controlling the engine disposed at the other end of the engine including a throttle valve control for controlling the speed of the engine and a throttle valve position sensor for sensing the position of a throttle valve controlled by said throttle valve control and providing a control signal to the fuel injection system.

7. A fuel injection system for an internal combustion engine as set forth in claim 6 wherein the fuel filter comprises an outer housing containing a filter element and wherein the bypassed fuel is returned to the filter housing upstream of the filter element.

8. A fuel injection system for an internal combustion engine as set forth in claim 7 wherein the fuel injector is disposed on one side of the engine and the engine operates on a two cycle crankcase compression and further including a control valve for controlling the opening and closing of the exhaust port of the engine on the other side of the engine.

9. A fuel injection system for an internal combustion engine as set forth in claim 8 wherein the engine has a pair of cylinder banks defining a valley therebetween and wherein the fuel injectors for the respective banks are positioned in the valley and wherein the exhaust control valves are disposed outside of the valley of the engine.

10. A fuel injection system for an internal combustion engine as set forth in claim 9 further including pressure sensing means for providing a signal indicative of the pressure in the crankcase for determining air flow to the engine and controlling the amount of fuel supplied by the fuel injectors, and means for precluding the exertion of a negative pressure on the pressure sensing means.

11. A fuel injection system for an internal combustion engine as set forth in claim 10 wherein the means for preventing the exertion of a negative pressure on the pressure sensing means comprises an atmospheric air bleed adapted to open when the crankcase pressure is below atmospheric.

12. A fuel injection system for an internal combustion engine as set forth in claim 11 wherein there are provided a pair of fuel injectors in series relationship for each cylinder bank with a single pressure regulator for regulating the pressure supply to each of the fuel injectors.

13. A fuel injection system for an internal combustion engine as set forth in claim 12 wherein the pressure regulator is positioned downstream of the fuel injectors.

14. A fuel injection system for an internal combustion engine having a main body rotatably journalling an output shaft about an axis, said axis extending between opposite ends of said engine, a fuel pump and fuel filter at one end of said engine, throttle means for controlling the speed of said engine, throttle actuating means at the other end of said engine for operating said throttle means, and throttle position sensing means for sensing the position of said throttle means at said other end of said engine.

15. A fuel injection system for an internal combustion engine as set forth in claim 14 wherein the throttle actuating means includes a throttle valve shaft and a pulley affixed to said throttle valve shaft.

16. A fuel injection system for an internal combustion engine as set forth in claim 14 wherein the body defines a pair of inclined cylinder banks defining a valley therebetween.

17. A fuel injection system for an internal combustion engine as set forth in claim 16 further including fuel injection means disposed in the valley of the engine for injecting fuel into the cylinder banks.

18. A fuel injection system for an internal combustion engine as set forth in claim 17 wherein the engine operates on a two cycle, crankcase compression principal and further including exhaust control valve means for controlling the timing of the exhaust port opening disposed outside of the valley of the engine.

19. A fuel injection system for an internal combustion engine as set forth in claim 17 further including means for providing a signal indicative of the pressure in the crankcase for determining air flow to the engine and controlling the amount of fuel supplied by the fuel injectors and means for precluding the exertion of a negative pressure on the pressure sensing means.

20. A fuel injection system for an internal combustion engine as set forth in claim 19 wherein the means for preventing the exertion of a negative pressure on the pressure sensing means comprises an atmospheric air bleed adapted to open when the crankcase pressure is below atmospheric.

21. A fuel injection system for a two cycle, crankcase compression, internal combustion engine comprising a crankcase chamber into which an atmospheric charge is inducted and compressed for admission to a combustion chamber, a fuel injector for delivering fuel to said combustion chamber, pressure sensing means for sensing the pressure in said crankcase chamber for providing a control parameter signal for controlling the amount of fuel supplied by said fuel injector, and means for precluding the transmission of negative pressure signals from said crankcase chamber to said pressure sensing means.

22. A fuel injection system for a two cycle, crankcase compression, internal combustion engine as set forth in claim 21 wherein the means for precluding the transmission of negative pressure signal from the crankcase chamber to the pressure sensing means comprises an atmospheric air bleed open when the pressure in the crankcase chamber is less than atmospheric.

23. A fuel injection system for a two cycle, crankcase compression, internal combustion engine as set forth in claim 22 wherein the atmospheric bleed is controlled by the check valve.

* * * * *